US011699379B2

(12) United States Patent
Pyo

(10) Patent No.: US 11,699,379 B2
(45) Date of Patent: Jul. 11, 2023

(54) DISPLAY DEVICE AND DRIVING METHOD OF DISPLAY DEVICE

(71) Applicant: Samsung Display Co., Ltd., Yongin-si (KR)

(72) Inventor: Si-Beak Pyo, Cheonan-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/834,126

(22) Filed: Jun. 7, 2022

(65) Prior Publication Data

US 2023/0085452 A1 Mar. 16, 2023

(30) Foreign Application Priority Data

Sep. 15, 2021 (KR) ..... 10-2021-0122963

(51) Int. Cl.

| | |
|---|---|
| ***G09G 1/20*** | (2006.01) |
| ***G09G 3/20*** | (2006.01) |
| ***G09G 3/32*** | (2016.01) |

(52) U.S. Cl.

CPC ..... *G09G 3/2007* (2013.01); *G09G 3/32* (2013.01); *G09G 2310/027* (2013.01); *G09G 2320/041* (2013.01); *G09G 2320/0673* (2013.01); *G09G 2360/16* (2013.01)

(58) Field of Classification Search

CPC .. G09G 3/2007; G09G 3/32; G09G 2310/027; G09G 2320/041; G09G 2320/0673; G09G 2360/16

See application file for complete search history.

(56) References Cited

U.S. PATENT DOCUMENTS

| | | | | |
|---|---|---|---|---|
| 6,593,934 | B1 * | 7/2003 | Liaw | G09G 3/2092 345/590 |
| 9,478,166 | B2 | 10/2016 | Pyo et al. | |
| 9,892,682 | B2 | 2/2018 | Pyo | |
| 10,586,504 | B2 * | 3/2020 | Shin | G09G 3/3677 |
| 2015/0138251 | A1 | 5/2015 | Pyo | |

(Continued)

FOREIGN PATENT DOCUMENTS

| | | | |
|---|---|---|---|
| CN | 103198779 | A | 7/2013 |
| CN | 106782412 | A | 5/2017 |

(Continued)

*Primary Examiner* — Kenneth Bukowski

(74) *Attorney, Agent, or Firm* — Cantor Colburn LLP

(57) ABSTRACT

A display device includes a display panel which displays an image, a panel driving block which provides a data signal to the display panel, and a temperature measuring part which measures a temperature of the display panel and provides a measurement temperature to the panel driving block. The panel driving block includes a first memory which stores a reference gamma voltage corresponding to a predetermined reference temperature, a temperature difference calculating part which calculates a temperature difference between the reference temperature and the measurement temperature, and a compensation part which generates a correction gamma voltage by correcting the reference gamma voltage based on the temperature difference between the reference temperature and the measurement temperature. The data signal is generated based on the correction gamma voltage and the image signal.

17 Claims, 14 Drawing Sheets

(56) References Cited

U.S. PATENT DOCUMENTS

| | | | | |
|---|---|---|---|---|
| 2016/0027412 | A1* | 1/2016 | Igawa | G09G 3/3648 345/99 |
| 2016/0149574 | A1* | 5/2016 | Cui | H03K 19/00369 327/513 |
| 2018/0090062 | A1* | 3/2018 | Nakamura | G09G 3/3233 |
| 2018/0293937 | A1* | 10/2018 | Tong | G09G 3/36 |
| 2018/0293945 | A1* | 10/2018 | Wang | G09G 3/3291 |
| 2019/0164475 | A1* | 5/2019 | Zhao | G09G 3/006 |

FOREIGN PATENT DOCUMENTS

| | | | | |
|---|---|---|---|---|
| JP | 2018054915 | A | | 4/2018 |
| KR | 20080049282 | A | * | 6/2008 |
| KR | 1020150022160 | A | | 3/2015 |
| KR | 1020160148128 | A | | 12/2016 |
| KR | 102139693 | B1 | | 7/2020 |

* cited by examiner

FIG. 7B

MM2

| Reference Grayscale | Reference Temperature |
|---|---|
| RG1 | SRT1 |
| RG2 | SRT2 |
| ⋮ | ⋮ |
| RGn-1 | SRTn-1 |
| RGn | SRTn |

SRT1
SRT2
⋮
SRTn-1
SRTn
RT

FIG. 7C

LUT

| | DT1 | DT2 | DT3 | • • • | DTm |
|---|---|---|---|---|---|
| RG1 | GCV11 | GCV12 | GCV13 | • • • | GCV1m |
| RG2 | GCV21 | GCV22 | GCV23 | • • • | GCV2m |
| RG3 | GCV31 | GCV32 | GCV33 | • • • | GCV3m |
| ⋮ | ⋮ | ⋮ | ⋮ | ⋮ | ⋮ |
| RGn | GCVn1 | GCVn2 | GCVn3 | • • • | GCVnm |

GCV11
⋮
GCVnm
} GCV

DISPLAY DEVICE AND DRIVING METHOD OF DISPLAY DEVICE

This application claims priority to Korean Patent Application No. 10-2021-0122963, filed on Sep. 15, 2021, and all the benefits accruing therefrom under 35 U.S.C. § 119, the content of which in its entirety is herein incorporated by reference.

BACKGROUND

1. Field

Embodiments of the disclosure described herein relate to a display device and a method of driving the display device, and more particularly, relate to a display device with improved reliability of display quality and a driving method of the display device.

2. Description of the Related Art

Various display devices have been developed to be used in a multi-media device such as a television, a mobile phone, a tablet computer, a navigation system, or a game console.

As such display devices are used in more various fields, the types of display panels for displaying an image displayed on display devices are diversified.

Recently, a display panel typically includes a light emitting display panel. The light emitting display panel may include an organic light emitting display panel or a quantum dot light emitting display panel.

SUMMARY

Embodiments of the disclosure provide a display device capable of maintaining the reliability of display quality regardless of the temperature of the display device, and a method of driving the display device.

According to an embodiment, a display device includes a display panel which displays an image, a panel driving block which receives an image signal from an outside and provides a data signal to the display panel, and a temperature measuring part which measures a temperature of the display panel and provides a measurement temperature to the panel driving block. In such an embodiment, the panel driving block includes a first memory which stores a reference gamma voltage corresponding to a reference temperature, which is predetermined, a temperature difference calculating part which calculates a temperature difference between the reference temperature and the measurement temperature, and a compensation part which generates a correction gamma voltage by correcting the reference gamma voltage based on the temperature difference between the reference temperature and the measurement temperature. In such an embodiment, the data signal is generated based on the correction gamma voltage and the image signal.

In an embodiment of the disclosure, the panel driving block may further include a lookup table which stores a plurality of gamma correction values corresponding to each of a plurality of temperature differences. In such an embodiment, the compensation part may read out a gamma correction value, which corresponds to the temperature difference between the reference temperature and the measurement temperature, from among the gamma correction values from the lookup table.

In an embodiment of the disclosure, the compensation part may read out the reference gamma voltage from the first memory. In such an embodiment, the compensation part may generate the correction gamma voltage by correcting the reference gamma voltage based on the gamma correction value.

In an embodiment of the disclosure, the panel driving block may further include a second memory that stores the reference temperature.

In an embodiment of the disclosure, the temperature difference calculating part may read out the reference temperature from the second memory and receive the measurement temperature from the temperature measuring part.

In an embodiment of the disclosure, the display panel may display the image based on one reference luminance among a plurality of reference luminances. In such an embodiment, the first memory may store a plurality of reference gamma voltages respectively corresponding to the reference luminances. In such an embodiment, the reference gamma voltage may be a voltage, which corresponds to the reference luminance, from among the reference gamma voltages.

In an embodiment of the disclosure, the panel driving block may further include a second memory that stores a plurality of reference temperatures respectively corresponding to the plurality of reference luminances. In such an embodiment, the reference temperature is a temperature, which corresponds to the reference luminance, from among the reference temperatures.

In an embodiment of the disclosure, the panel driving block may further include a temperature extracting part which reads out the reference temperature from the second memory. In such an embodiment, the temperature extracting part may provide the reference temperature to the compensation part.

In an embodiment of the disclosure, the panel driving block may further include a lookup table including a plurality of correction tables, each of which stores a plurality of gamma correction values corresponding to each of a plurality of temperature differences for each of the reference luminances. In such an embodiment, the compensation part may read out a gamma correction value, which corresponds to the reference luminance and the temperature difference between the reference temperature and the measurement temperature, from among the gamma correction values, from the lookup table.

In an embodiment of the disclosure, the compensation part may include a gamma extracting part which reads out the reference gamma voltage from the first memory and a correction value generating part which reads out the gamma correction value from the lookup table. In such an embodiment, the compensation part may further include a correction gamma generating part which receives the reference gamma voltage from the gamma extracting part, receives the gamma correction value from the correction value generating part, and generates the correction gamma voltage by correcting the reference gamma voltage based on the gamma correction value.

In an embodiment of the disclosure, the reference gamma voltage may include a plurality of sub-gamma voltages respectively corresponding to a plurality of reference grayscales. In such an embodiment, the reference temperature may include a plurality of sub-reference temperatures respectively corresponding to the reference grayscales, and the temperature difference may include a plurality of sub-temperature differences which are temperature differences between the measurement temperature and the sub-reference temperatures.

In an embodiment of the disclosure, the panel driving block may further include a lookup table which stores a plurality of gamma correction values corresponding to each of a plurality of temperature differences for each of the reference grayscales. In such an embodiment, the compensation part may read out a gamma correction value, which corresponds to the temperature difference between the reference temperature and the measurement temperature, from among the gamma correction values, from the lookup table.

In an embodiment of the disclosure, the compensation part may read out the reference gamma voltage from the first memory. In such an embodiment, the compensation part may generate the correction gamma voltage by correcting the reference gamma voltage based on the gamma correction value.

In an embodiment of the disclosure, the panel driving block may include a controller including the temperature difference calculating part and the compensation part, where the controller may generate image data based on the image signal and. In such an embodiment, the panel driving block may further include a source driver which generates the data signal based on the image data and the correction gamma voltage and provides the data signal to the display panel.

According to an embodiment, a driving method of a display device includes measuring a temperature of a display panel through a temperature measuring part and calculating a temperature difference between the measured temperature and a reference temperature, which is predetermined. In such an embodiment, the driving method of the display device further includes reading out a gamma correction value corresponding to the temperature difference between the reference temperature and the measurement temperature from a lookup table, in which a plurality of gamma correction values corresponding to each of a plurality of temperature differences are stored, and generating a correction gamma voltage by correcting a reference gamma voltage corresponding to the reference temperature based on the gamma correction value.

In an embodiment of the disclosure, the driving method of the display device may further include reading out the reference gamma voltage from a first memory in which the reference gamma voltage corresponding to the reference temperature is stored.

In an embodiment of the disclosure, the driving method of the display device may further include reading out the reference temperature from a second memory in which the reference temperature is stored.

In an embodiment of the disclosure, the display panel may display the image based on one reference luminance among a plurality of reference luminances. In such an embodiment, the first memory may store a plurality of reference gamma voltages respectively corresponding to the plurality of reference luminances, and the reference gamma voltage may be a voltage corresponding to the reference luminance among the reference gamma voltages.

In an embodiment of the disclosure, the second memory may store a plurality of reference temperatures respectively corresponding to the plurality of reference luminances, and the reference temperature may be a temperature, which corresponds to the reference luminance, from among the reference temperatures.

In an embodiment of the disclosure, the lookup table may store a plurality of gamma correction values corresponding to each of the temperature differences for each of the reference luminances. In such an embodiment, the gamma correction value may be a correction value, which corresponds to the reference luminance and the reference temperature, from among the gamma correction values.

BRIEF DESCRIPTION OF THE DRAWINGS

The above and other features of the disclosure will become apparent by describing in detail embodiments thereof with reference to the accompanying drawings.

FIG. 7B is a conceptual diagram for describing a reference temperature stored in a second memory, according to an embodiment of the disclosure.

FIG. 7C is a conceptual diagram for describing gamma correction values stored in a lookup table, according to an embodiment of the disclosure.

DETAILED DESCRIPTION

Figure 1:
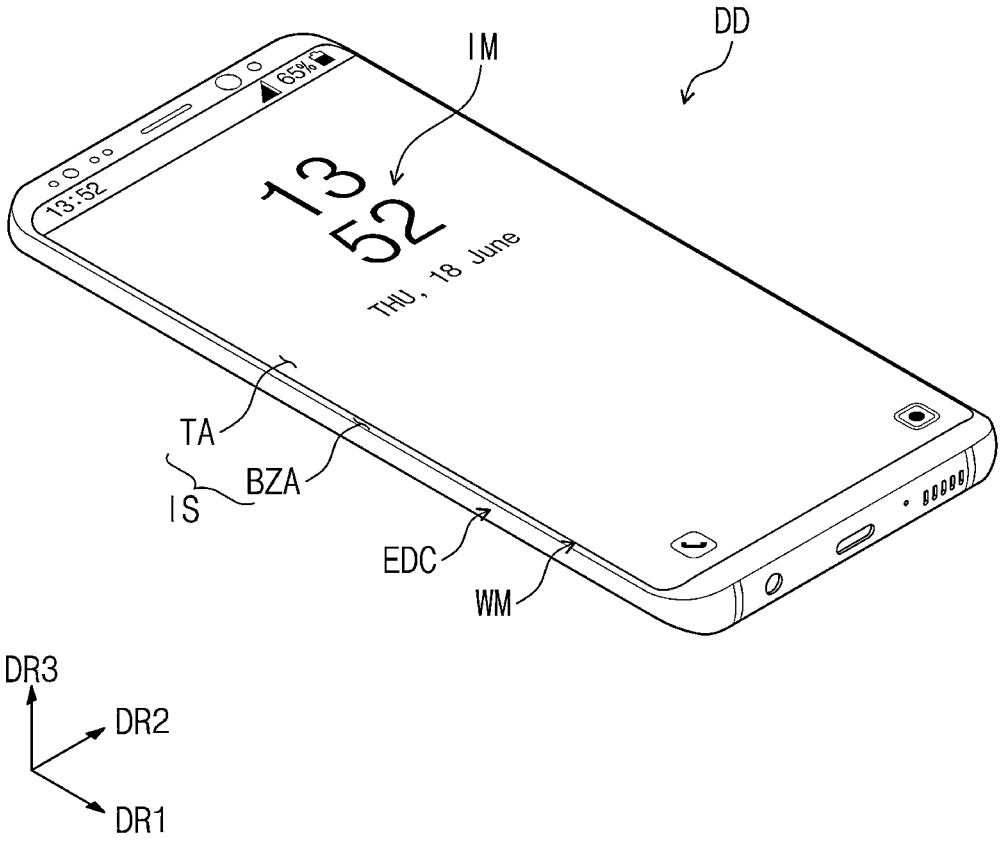
FIG. 1 is a perspective view illustrating a display device, according to an embodiment of the disclosure.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

In the specification, the expression that a first component (or region, layer, part, portion, etc.) is "on", "connected with", or "coupled with" a second component means that the first component is directly on, connected with, or coupled with the second component or means that a third component is interposed therebetween.

The same reference numerals refer to the same components. Also, in drawings, the thickness, ratio, and dimension of components are exaggerated for effectiveness of description of technical contents.

Although the terms "first", "second", etc. may be used to describe various components, the components should not be construed as being limited by the terms. The terms are only used to distinguish one component from another component. For example, without departing from the scope and spirit of the disclosure, a first component may be referred to as a second component, and similarly, the second component may be referred to as the first component.

Also, the terms "under", "below", "on", "above", etc. are used to describe the correlation of components illustrated in drawings. The terms that are relative in concept are described based on a direction shown in drawings.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical terms and scientific terms) used in the specification have the same meaning as commonly understood by one skilled in the art to which the disclosure belongs. Furthermore, terms such as terms defined in the dictionaries commonly used should be interpreted as having a meaning consistent with the meaning in the context of the related technology, and should not be interpreted in ideal or overly formal meanings unless explicitly defined herein.

Embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, embodiments of the disclosure will be described in detail with reference to accompanying drawings.

Figure 2:
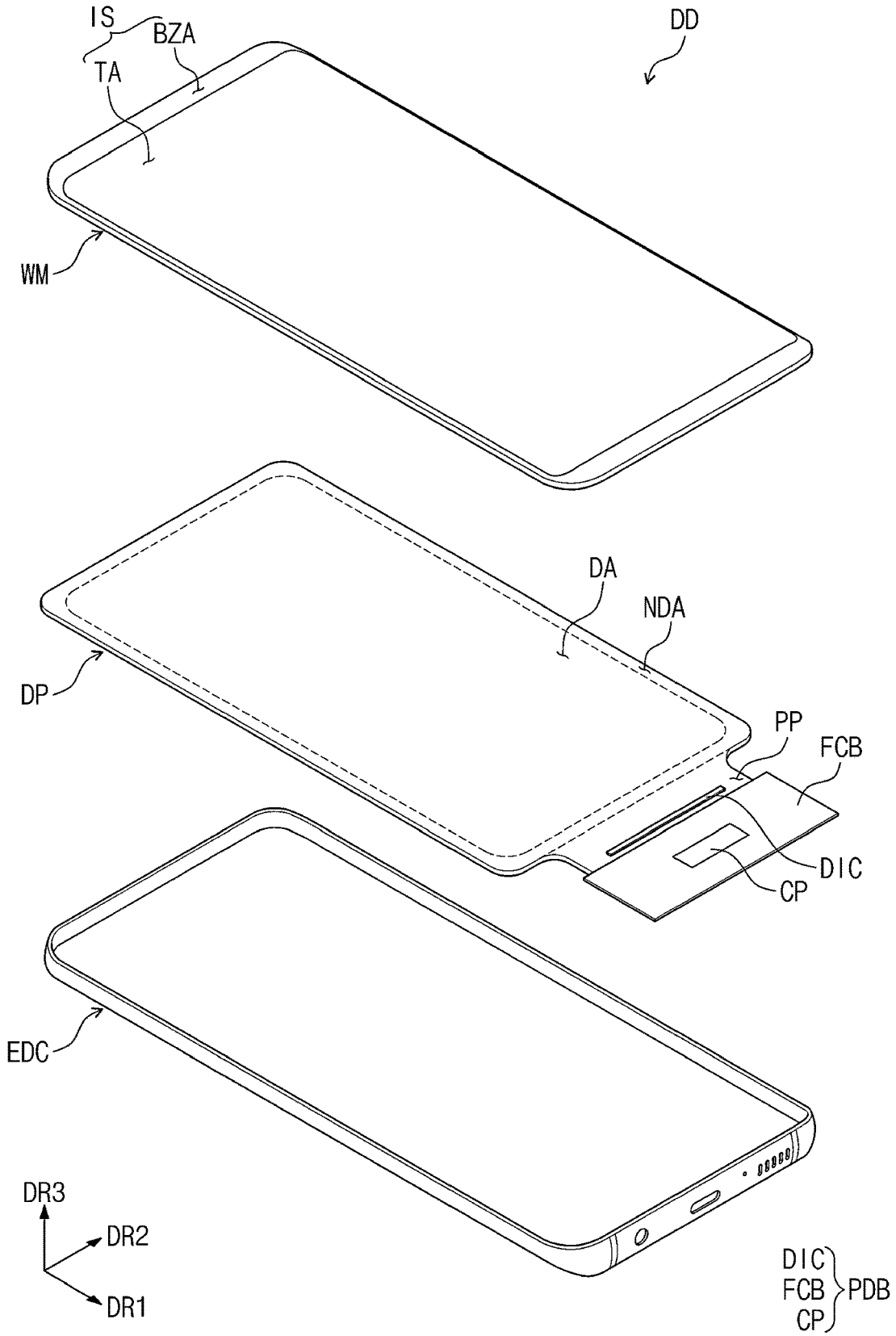
FIG. 2 is an exploded perspective view of a display device, according to an embodiment of the disclosure.

FIG. 1 is a perspective view of a display device, according to an embodiment of the disclosure. FIG. 2 is an exploded perspective view of a display device, according to an embodiment of the disclosure.

Referring to FIG. 1, an embodiment of the display device DD may be a device activated depending on an electrical signal. FIGS. 1 and 2 illustrate an embodiment where the display device DD is a smartphone. However, the disclosure is not limited thereto. In an alternative embodiment, for example, as well as a large-sized display device, such as a television, a monitor, or the like, the display device DD may be a small and medium-sized display device, such as a tablet personal computer ("PC"), a notebook computer, a vehicle navigation system, a game console, or the like. Alternatively, the display device DD may be applied to any other display device(s) without departing from the concept of the disclosure.

In an embodiment, the display device DD has a long side in a first direction DR1 and a short side in a second direction DR2 intersecting the first direction DR1. The display device DD has a quadrangle whose vertexes are rounded. However, the shape of the display device DD is not limited thereto. In an alternative embodiment, for example, the display device DD may be implemented in various shapes. The display device DD may display an image IM on a display surface IS parallel to each of the first direction DR1 and the second direction DR2, to face a third direction DR3. The display surface IS on which the image IM is displayed may correspond to a front surface of the display device DD.

In an embodiment, a front surface (or an upper/top surface) and a rear surface (or a lower/bottom surface) of each member are defined based on a direction in which the image IM is displayed. The front surface and the rear surface are opposite to each other in the third direction DR3, and a normal direction to the front surface and the rear surface may parallel to the third direction DR3.

A separation distance between the front surface and the rear surface in the third direction DR3 may correspond to a thickness of the display device DD in the third direction DR3. Here, directions that the first, second, and third directions DR1, DR2, and DR3 indicate may be relative in concept and may be changed to different directions.

The display surface IS of the display device DD may be divided into a transparent area TA and a bezel area BZA. The transparent area TA may be an area in which the image IM is displayed. A user visually perceives the image IM through the transparent area TA. In an embodiment, the transparent area TA is illustrated in the shape of a quadrangle whose vertexes are rounded. However, this is illustrated as an embodiment. The transparent area TA may have various shapes, not limited to one embodiment.

The bezel area BZA is adjacent to the transparent area TA. The bezel area BZA may have a predetermined color. The bezel area BZA may surround the transparent area TA. Accordingly, the shape of the transparent area TA may be substantially defined by the bezel area BZA. However, this is illustrated as an embodiment. In an alternative embodiment, for example, the bezel area BZA may be disposed adjacent to only one side of the transparent area TA or may be omitted. The display device DD according to an embodiment of the disclosure may be variously modified and is not limited to one embodiment.

In an embodiment, as illustrated in FIG. 2, the display device DD may include a window WM, a display panel DP, and an external case EDC.

The window WM protects an upper surface of the display panel DP. The window WM may be optically transparent. The window WM may include a transparent material to output the image IM. In an embodiment, for example, the window WM may include glass, sapphire, or plastic. In an embodiment, the window WM may be implemented with a single layer. However, an embodiment is not limited thereto. In an alternative embodiment, for example, the window WM may include a plurality of layers.

In an embodiment, although not illustrated in drawings, the bezel area BZA of the display device DD described above may correspond to an area that is defined by printing a material including a given color on one area of the window WM. In an embodiment of the disclosure, the window WM may include a light blocking pattern for defining the bezel area BZA. In an embodiment, the light shielding pattern may be in the form of an organic film having a color, and may be, for example, formed in a coating manner.

The window WM may be coupled to the display panel DP through an adhesive film. In an embodiment of the disclosure, the adhesive film may include an optically clear adhesive ("OCA") film. However, the adhesive film is not limited thereto, but may include a typical adhesive agent and adhesion agent. In an alternative embodiment, for example, the adhesive film may include an optically clear resin ("OCR") film or a pressure sensitive adhesive ("PSA") film.

An anti-reflective layer may be further interposed between the window WM and the display panel DP. The anti-reflective layer reduces a reflective index of external light incident from an upper portion of the window WM. According to an embodiment of the disclosure, the anti-reflective layer may include a retarder and a polarizer. The retarder may be a retarder of a film type or a liquid crystal coating type and may include a $\lambda/2$ retarder and/or a $\lambda/4$ retarder. The polarizer may be provided in a film type or a liquid coating type. The film type may include a stretch-type synthetic resin film, and the liquid crystal coating type may include liquid crystals arranged in a given direction. The retarder and the polarizer may be implemented with a single polarization film.

In an embodiment of the disclosure, the anti-reflection layer may also include color filters. The arrangement of the color filters may be determined in consideration of colors of light generated from a plurality of pixels included in the display panel DP. The anti-reflective layer may further include a light shielding pattern.

The display panel DP may include a display area DA displaying an image IM. The display area DA may be an area through which the image IM provided from the display panel DP is output. A non-display area NDA is adjacent to the display area DA. In an embodiment, for example, the non-display area NDA may surround the display area DA. However, this is illustrated as an embodiment. The non-display area NDA may be defined in various shapes, not limited to one embodiment. According to an embodiment, the display area DA of the display panel DP may correspond to at least a portion of the transparent area TA.

According to an embodiment of the disclosure, the display panel DP may include a light emitting display panel. In an embodiment, for example, the display panel DP may be an organic light emitting display panel, an inorganic light emitting display panel, or a quantum dot light emitting display panel. An emission layer of the organic light-emitting display layer may include an organic light-emitting material. An emission layer of the inorganic light emitting display panel may include an inorganic light emitting material. A light emitting layer of the quantum dot light emitting display panel may include a quantum dot and a quantum rod. Hereinafter, for convenience of description, embodiments where the display panel DP is an organic light-emitting display will be described in detail, but not being limited thereto.

In an embodiment of the disclosure, the display device DD may further include an input sensing layer for sensing an external input (e.g., a touch event, or the like). The input sensing layer may be directly disposed on the display panel DP. According to an embodiment of the disclosure, the input sensing layer may be formed on the display panel DP through a subsequent process. In such an embodiment, when the input sensing layer is directly disposed on the display panel DP, an adhesive film may not be interposed between the input sensing layer and the display panel DP. However, the disclosure is not limited thereto. In an alternative embodiment, for example, the adhesive film may be interposed between the input sensing layer and the display panel DP. In such an embodiment, the input sensing layer is not fabricated together with the display panel DP through the subsequent processes. In such an embodiment, after fabricating the input sensing layer through a process separate from that of the display panel DP, the input sensing layer may be fixed on a top surface of the display panel DP through the adhesive film.

In an embodiment of the disclosure, the display device DD may further include a driver chip DIC, a controller CP, and a flexible circuit film FCB. In an embodiment of the disclosure, the display panel DP may further include a pad area PP extending from the non-display area NDA. In an embodiment of the disclosure, the driver chip DIC, the controller CP, and the flexible circuit film FCB may be collectively referred to as a "panel driving block PDB".

The driver chip DIC and pads may be positioned in the pad area PP. The display panel DP may be electrically connected to the printed circuit board FCB through the pads. In an embodiment of the disclosure, the driver chip DIC may be mounted on the flexible circuit film FCB. The flexible circuit film FCB may include a plurality of driving elements. The plurality of driving elements may include a circuit unit for driving the display panel DP. In an embodiment of the disclosure, the driver chip DIC may include a source driver that provides a data signal DS (see FIG. 3) for displaying the image IM on the display panel DP. Hereinafter, for convenience of description, the driver chip DIC is referred to as a "source driver DIC". In an embodiment of the disclosure, the pad area PP may be bent to be positioned on or under a rear surface of the display panel DP.

In an embodiment of the disclosure, the controller CP may be mounted on the flexible circuit film FCB. An operation of the controller CP and a relationship between the controller CP and the source driver DIC will be described later with reference to FIG. 3.

The external case EDC may be coupled to the window WM to define the outer appearance of the display device DD. The external case EDC may absorb external shocks from the outside and may prevent a foreign material/moisture or the like from being infiltrated into the display panel DP such that components accommodated in the external case EDC are protected. In an embodiment of the disclosure, the external case EDC may be implemented by coupling a plurality of accommodating members.

In an embodiment, the display device DD may further include an electronic module including various functional modules for operating the display panel DP, a power supply module for supplying a power necessary for overall operations of the display device DD, a bracket coupled with the external case EDC to partition an inner space of the display device DD, or the like.

Figure 3:
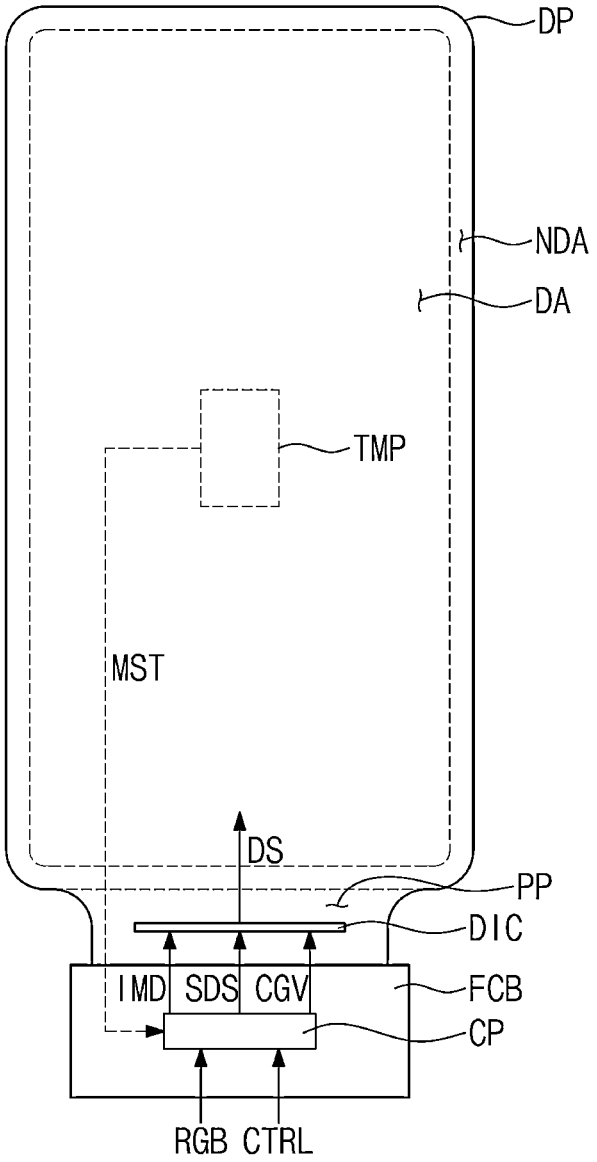
FIG. 3 is a plan view illustrating a display panel and a temperature measuring part, according to an embodiment of the disclosure.

FIG. 3 is a plan view illustrating a display panel and a temperature measuring part, according to an embodiment of the disclosure.

Referring to FIG. 3, an embodiment of the display device DD (see FIG. 2) may further include a temperature measuring part TMP. In an embodiment of the disclosure, as shown in FIG. 3, the temperature measuring part TMP may be disposed under the display panel DP. However, the disclosure is not limited thereto. In an alternative embodiment, for example, the temperature measuring part TMP may be disposed above the display panel DP. In another alternative embodiment, the temperature measuring part TMP may be included in the display panel DP or in an input sensing layer for sensing an external input.

The display device DD includes the controller CP and the source driver DIC. The controller CP receives an image signal RGB and a control signal CTRL. The controller CP generates image data IMD by converting a data format of the image signal RGB in compliance with the specification for an interface with the source driver DIC. The controller CP generates a source driving signal SDS based on the control signal CTRL. In an embodiment of the disclosure, the control signal CTRL may include a vertical synchronization signal, a horizontal synchronization signal, a main clock, or the like.

The temperature measuring part TMP may measure the temperature of the display panel DP and then may provide a measured temperature MST to the controller CP. In an embodiment of the disclosure, the temperature measuring part TMP may measure the temperature of the display panel DP at regular intervals. Accordingly, during the operation of the display device DD, the temperature measuring part TMP may measure the temperature of the display panel DP, which is changed depending on a change in the external environment of the display device DD, the type of the image IM displayed on the display panel DP, and a time during which the image IM is displayed.

In an embodiment of the disclosure, the temperature measuring part TMP may be positioned or disposed to overlap the display area DA. The temperature measuring part TMP may measure the temperature at a center of the display panel DP. However, the disclosure is not limited thereto. In an embodiment, the temperature measuring part TMP may be arranged to overlap the non-display area NDA. In an embodiment, the temperature measuring part TMP may measure the temperature of an external portion of the display panel DP and then may also calculate the temperature at the center of the display panel DP based on the temperature of the external portion of the display panel DP.

The controller CP provides the image data IMD and the source driving signal SDS to the source driver DIC. The source driving signal SDS may include a horizontal start signal for starting an operation of the source driver DIC. The controller CP provides a correction gamma voltage CGV to the source driver DIC. In an embodiment of the disclosure, the controller CP may correct a predetermined and stored reference gamma voltage RGV (see FIG. 6) based on a measurement temperature MST provided from the temperature measuring part TMP and then may generate a correction gamma voltage CGV. An operation in which the controller CP corrects the reference gamma voltage RGV based on the measurement temperature MST will be described later in detail with reference to FIGS. 6 to 9C.

The source driver DIC converts the image data IMD into the data signal DS based on the source driving signal SDS and the correction gamma voltage CGV. The source driver DIC provides the data signal DS to the display panel DP. The data signal DS may refer to an analog voltage corresponding to a grayscale value of the image data IMD.

In an embodiment, although not illustrated in FIG. 3, the display device DD may further include a gate driver. In an embodiment of the disclosure, the controller CP may transmit a gate control signal to the gate driver. The gate driver may apply the data signal DS to a plurality of pixels included in the display panel DP based on the gate control signal, may generate a scan signal for adjusting the timing at which pixels display the image IM, and may provide the scan signal to the display panel DP.

Figure 4:
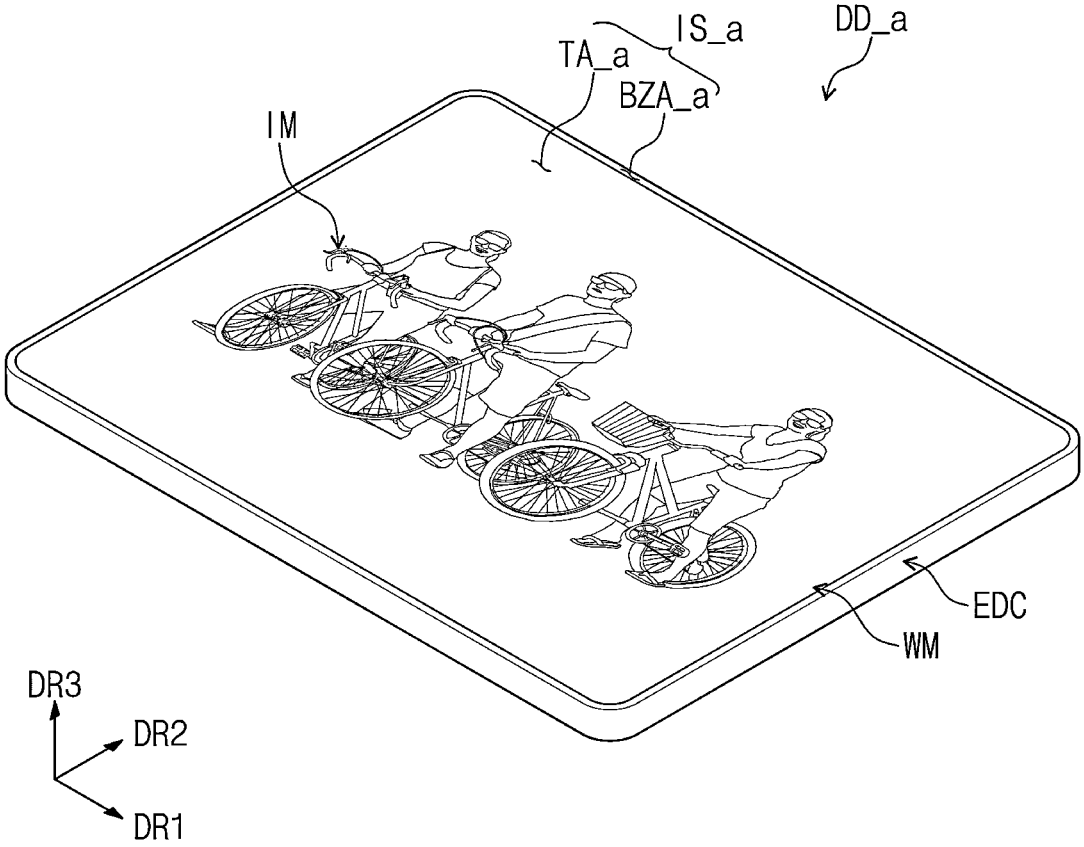
FIG. 4 is a perspective view of a display device, according to an embodiment of the disclosure.
Figure 5:
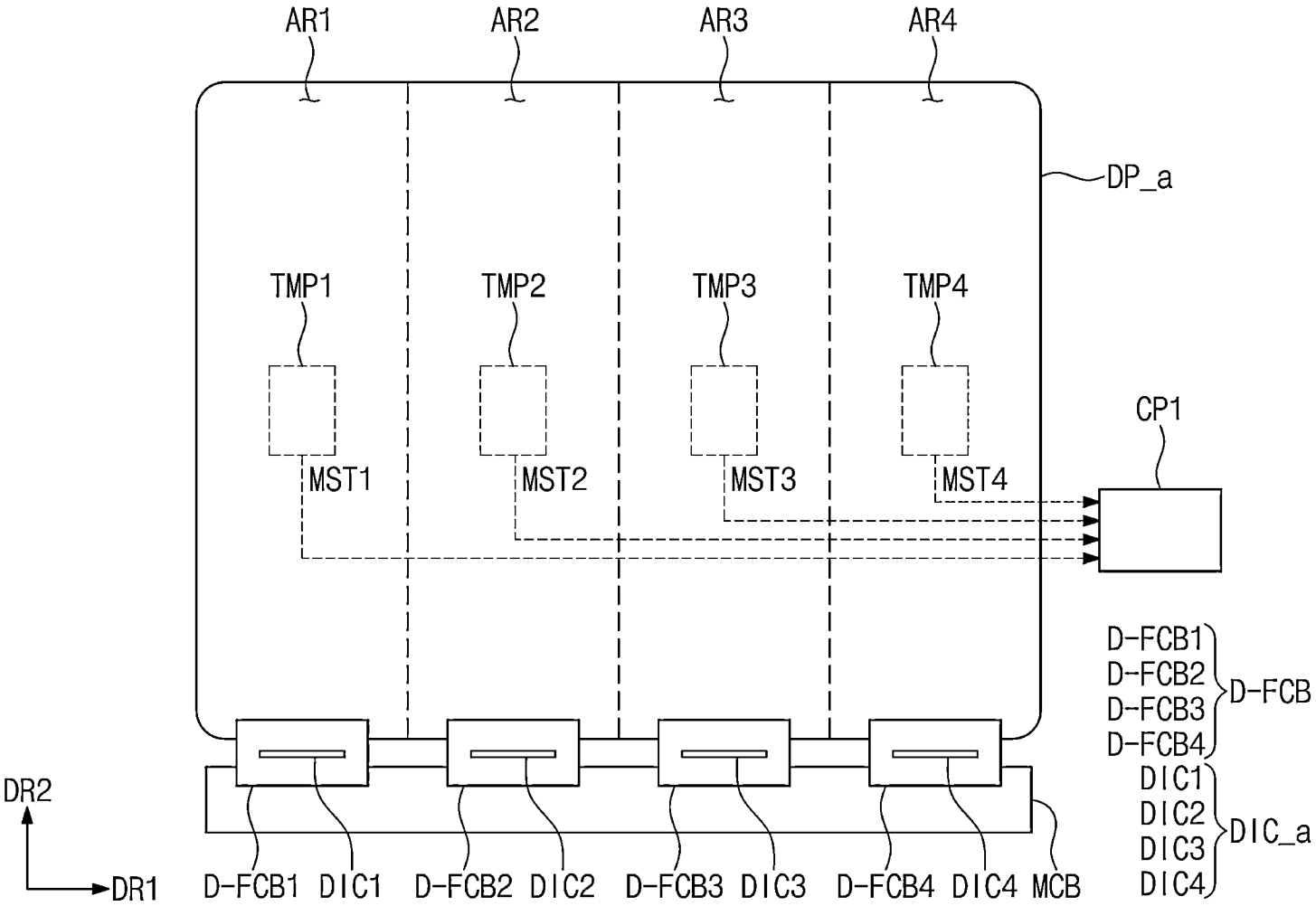
FIG. 5 is a plan view illustrating a display panel and a temperature measuring part, according to an embodiment of the disclosure.

FIG. 4 is a perspective view of a display device, according to an embodiment of the disclosure. FIG. 5 is a plan view illustrating a display panel and a temperature measuring part, according to an embodiment of the disclosure. The same or like elements shown in FIGS. 4 and 5 have been labeled with the same reference characters as used above to describe the embodiments of the display device DD shown in FIGS. 1 to 3, and any repetitive detailed description thereof will hereinafter be omitted or simplified.

FIGS. 1 and 3 illustrate an embodiment where the display device DD is a smartphone. However, the disclosure is not limited thereto. In an alternative embodiment, for example, as show in FIGS. 4 and 5, a display device DD_a may be a large-sized display device, such as a television, a monitor, or the like. In such an embodiment, as shown in FIG. 4, a display surface IS_a of the display device DD_a may be divided into a transparent area TA_a and a bezel area BZA_a.

In an embodiment, where the display device DD_a is the large-sized display device such as a television or monitor, the display device DD_a may further include a main circuit board MCB, a plurality of flexible circuit films D-FCB, and a plurality of driver chips DIC_a. The main circuit board MCB may be connected with the flexible circuit films D-FCB to be electrically connected with the display panel DP_a. The flexible circuit films D-FCB may be connected with the display panel DP_a to electrically connect the display panel DP_a and the main circuit board MCB to each other. The main circuit board MCB may include a plurality of driver elements. The plurality of driving elements may include a circuit unit for driving the display panel DP_a. The driver chips DIC_a may be mounted on the flexible circuit films D-FCB.

In an embodiment of the disclosure, the flexible circuit films D-FCB may include a first flexible circuit film D-FCB1, a second flexible circuit film D-FCB2, a third flexible circuit film D-FCB3, and a fourth flexible circuit film D-FCB4. The driver chips DIC_a may include a first driver chip DIC1, a second driver chip DIC2, a third driver chip DIC3, and a fourth driver chip DIC4. The first to fourth flexible circuit films D-FCB1, D-FCB2, D-FCB3, and D-FCB4 may be arranged spaced from each other in the first direction DR1 and may be connected with the display panel DP_a to electrically connect the display panel DP_a and the main circuit board MCB to each other. The first driver chip DIC1 may be mounted on the first flexible circuit film D-FCB1. The second driver chip DIC2 may be mounted on the second flexible circuit film D-FCB2. The third driver chip DIC3 may be mounted on the third flexible circuit film D-FCB3. The fourth driver chip DIC4 may be mounted on the fourth flexible circuit film D-FCB4. However, an embodiment of the disclosure is not limited thereto. In an alternative embodiment, for example, the display panel DP_a may be electrically connected with the main circuit board MCB through one flexible circuit film, and only a single driver chip may be mounted on the one flexible circuit film. Alternatively, the display panel DP_a may be electrically connected with the main circuit board MCB through five or more flexible circuit films, and driver chips may be respectively mounted on the flexible circuit films. Hereinafter, for convenience of description, the first driver chip DIC1 is referred to as a first source driver DIC1, the second driver chip DIC2 is referred to as a second source driver DIC2, the third driver chip DIC3 is referred to as a third source driver DIC3, and the fourth driver chip DIC4 is referred to as a fourth source driver DIC4.

FIG. 5 illustrates an embodiment having a structure in which the first to fourth source drivers DIC1, DIC2, DIC3, and DIC4 are respectively mounted on the first to fourth flexible circuit films D-FCB1, D-FCB2, D-FCB3, and D-FCB4, but the disclosure is not limited thereto. In an alternatively embodiment, for example, the first to fourth source drivers DIC1, DIC2, DIC3, and DIC4 may be directly mounted on the display panel DP_a. In such an embodiment, a portion of the display panel DP_a, on which the first to fourth source drivers DIC1, DIC2, DIC3, and DIC4 are mounted, may be bent such that the first to fourth source drivers DIC1, DIC2, DIC3, and DIC4 are disposed on a rear surface of the display panel DP_a. In an embodiment, the first to fourth source drivers DIC1, DIC2, DIC3, and DIC4 may be directly mounted on the main circuit board MCB.

In an embodiment of the disclosure, the display panel DP_a may include first to fourth areas AR1, AR2, AR3, and AR4. The first area AR1 is an area corresponding to the first source driver DIC1 and the first flexible circuit film D-FCB1. The second area AR2 is an area corresponding to the second source driver DIC2 and the second flexible circuit film D-FCB2. The third area AR3 is an area corresponding to the third source driver DIC3 and the third flexible circuit film D-FCB3. The fourth area AR4 is an area corresponding to the fourth source driver DIC4 and the fourth flexible circuit film D-FCB4.

In an embodiment of the disclosure, the display device DD_a may further include first to fourth temperature measuring parts TMP1, TMP2, TMP3, and TMP4. The first temperature measuring part TMP1 may be disposed to overlap the first area AR1. The second temperature measuring part TMP2 may be disposed to overlap the second area AR2. The third temperature measuring part TMP3 may be disposed to overlap the third area AR3. The fourth temperature measuring part TMP4 may be disposed to overlap the fourth area AR4. In an embodiment of the disclosure, the first temperature measuring part TMP1 measures the temperature of the first area AR1 of the display panel DP_a and then provides the measured first measurement temperature MST1 to a controller CP1. In such an embodiment, the second temperature measuring part TMP2 measures the temperature of the second area AR2 of the display panel DP_a and then provides the measured second measurement temperature MST2 to the controller CP1, the third temperature measuring part TMP3 measures the temperature of the third area AR3 of the display panel DP_a and then provides the measured third measurement temperature MST3 to the controller CP1, and the fourth temperature measuring part TMP4 measures the temperature of the fourth area AR4 of the display panel DP_a and then provides the measured fourth measurement temperature MST4 to the controller CP1. The controller CP1 corrects the reference gamma voltage RGV (see FIG. 6) based on the provided first to fourth measurement temperatures MST1, MST2, MST3, and MST4, and then generates the correction gamma voltage CGV (see FIG. 6). In an embodiment of the disclosure, the correction gamma voltage CGV may include a first correction gamma voltage provided to the first source driver DIC1, a second correction gamma voltage provided to the second source driver DIC2, a third correction gamma voltage provided to the third source driver DIC3, and a fourth correction gamma voltage provided to the fourth source driver DIC4. Voltage levels of the first to fourth correction gamma voltages may be determined to correspond to the first to fourth measurement temperatures MST1, MST2, MST3, and MST4, respectively. In such an embodiment, as described above, the display device DD_a such as a television or monitor is large. Accordingly, even though each of the areas AR1, AR2, AR3, and AR4 of the display panel DP_a differ in temperature, the quality reliability of the image IM displayed on the display panel DP_a may be maintained.

Figure 6:
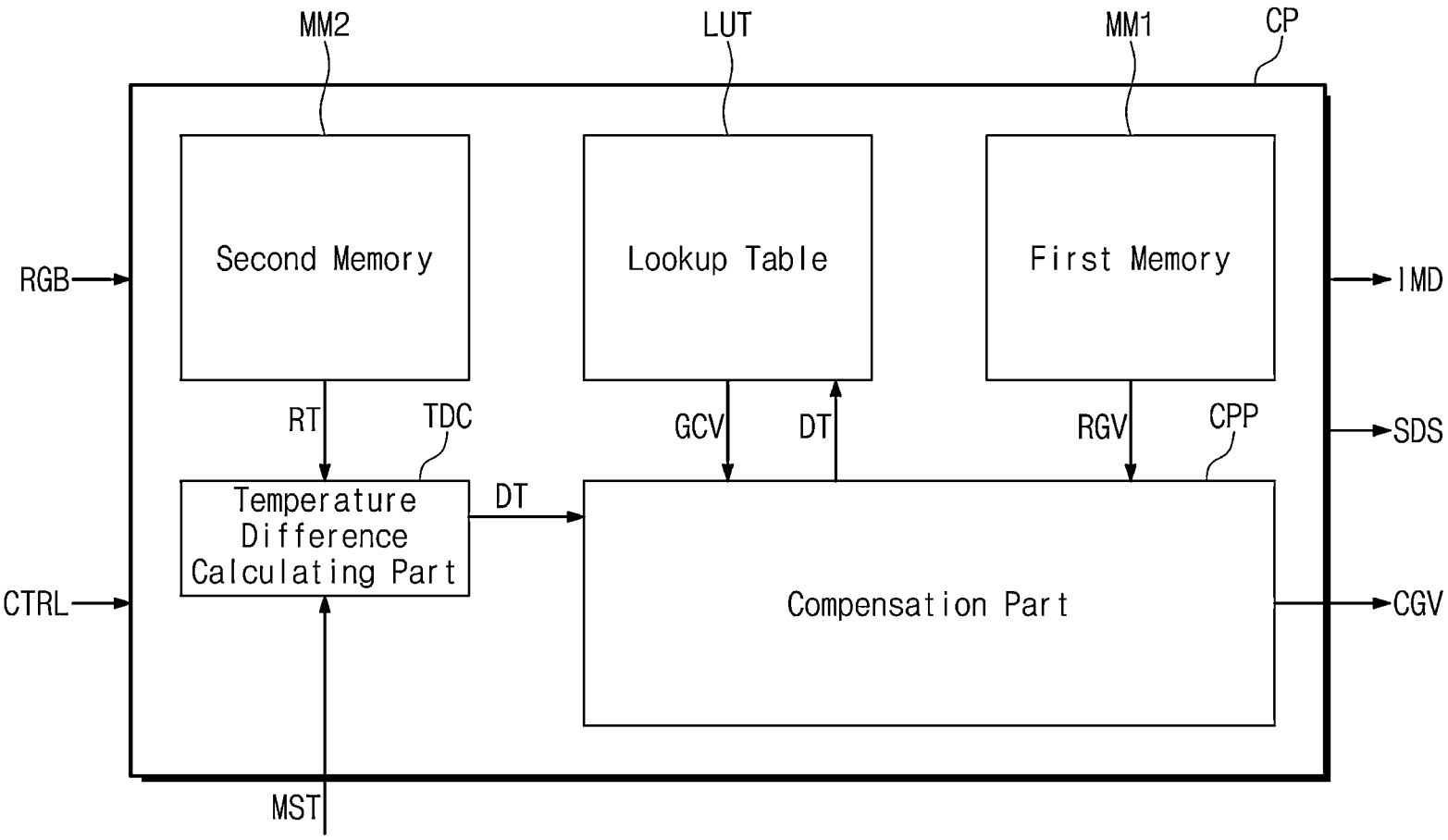
FIG. 6 is a block diagram for describing a structure of a controller, according to an embodiment of the disclosure.
Figure 7A:
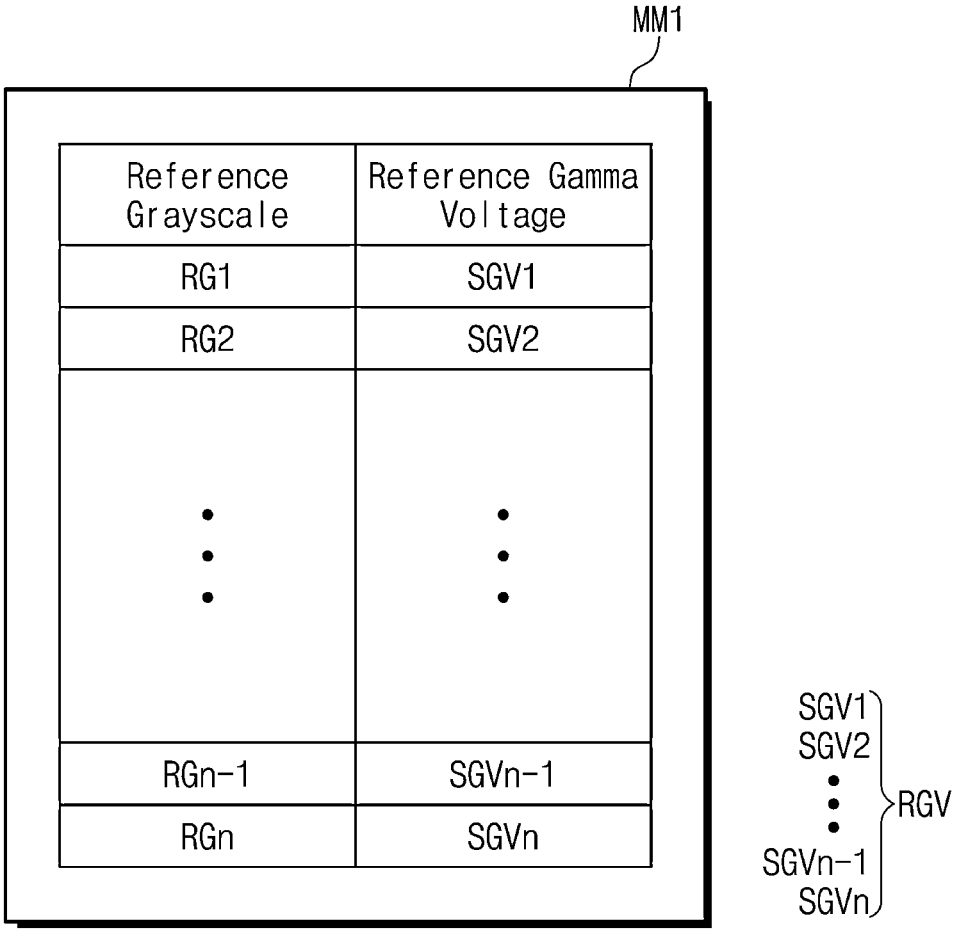
FIG. 7A is a conceptual diagram for describing a reference gamma voltage stored in a first memory, according to an embodiment of the disclosure.

FIG. 6 is a block diagram for describing a structure of a controller, according to an embodiment of the disclosure. FIG. 7A is a conceptual diagram for describing a reference gamma voltage stored in a first memory, according to an embodiment of the disclosure. FIG. 7B is a conceptual diagram for describing a reference temperature stored in a second memory, according to an embodiment of the disclosure. FIG. 7C is a conceptual diagram for describing gamma correction values stored in a lookup table, according to an embodiment of the disclosure.

Referring to FIG. 6, In an embodiment of the disclosure, the controller CP includes a temperature difference calculating part TDC, a compensation part CPP, a first memory MM1, a second memory MM2, and a lookup table LUT.

Referring to FIGS. 7A and 7B, In an embodiment of the disclosure, while the grayscale of the image IM (see FIG. 1) displayed on the display device DD (see FIG. 1) is changed at a reference temperature RT, the reference gamma voltage RGV is determined through a process of searching for an optimal voltage level of the data signal DS (see FIG. 3) for displaying the corresponding grayscale. In such an embodiment, a gamma curve capable of providing an optimal display quality to a user may be obtained at the reference temperature RT. The reference gamma voltage RGV may include sub-gamma voltages SGV1 to SGVn respectively corresponding to the reference grayscales RG1 to RGn.

In an embodiment of the disclosure, the temperature of the display device DD in a process of determining the reference gamma voltage RGV is referred to as the "reference temperature RT". The reference temperature RT of the display device DD may be continuously changed in a process of searching for an optimal voltage level of the data signal DS for displaying the corresponding grayscale while the grayscale of the image IM is changed. Accordingly, the reference temperature RT may include sub-reference temperatures SRT1 to SRTn respectively corresponding to the respective reference grayscales RG1 to RGn. In an embodiment of the disclosure, the reference temperature RT of the display device DD may be compared with the temperature measured through the temperature measuring part TMP (see FIG. 3).

The second memory MM2 stores the predetermined reference temperature RT. The first memory MM1 stores the reference gamma voltage RGV corresponding to the reference temperature RT. In an embodiment, the reference temperature RT includes the plurality of sub-reference temperatures SRT1 to SRTn corresponding to the plurality of reference grayscales RG1 to RGn, respectively. The second memory MM2 stores the sub-reference temperatures SRT1 to SRTn corresponding to the reference grayscales RG1 to RGn, respectively. The reference gamma voltage RGV includes the plurality of sub-gamma voltages SGV1 to SGVn corresponding to the reference grayscales RG1 to RGn, respectively. The first memory MM1 stores the sub-gamma voltages SGV1 to SGVn corresponding to the reference grayscales RG1 to RGn, respectively.

Referring to FIGS. 6 and 7C, the luminance and color coordinates of the image IM displayed on the display panel DP are affected by not only a voltage level of the data signal DS but also the temperature of the display panel DP. Accordingly, when there are temperature differences DT1 to DTm between the reference temperature RT at a point in time when the reference gamma voltage RGV is determined and the measurement temperature MST of the display panel DP measured through the temperature measuring part TMP, the display panel DP may have a gamma curve different from a gamma curve at a point in time when the reference gamma voltage RGV is determined. Accordingly, when the temperature differences DT1 to DTm are present or detected, the correction gamma voltage CGV may be generated by correcting the reference gamma voltage RGV based on a gamma correction value GCV. Even though the temperature differences DT1 to DTm are present, the display panel DP has a same gamma curve as the gamma curve at a point in time when the reference gamma voltage RGV is determined, by providing the correction gamma voltage CGV to the display panel DP. In such an embodiment, the quality reliability of the image IM displayed by the display panel DP may be maintained.

In an embodiment of the disclosure, the lookup table LUT may store the temperature differences DT1 to DTm and the gamma correction value GCV corresponding to the reference grayscales RG1 to RGn. The gamma correction value GCV may include a plurality of gamma correction values GCV11 to GCVnm corresponding to the temperature differences DT1 to DTm and the reference grayscales RG1 to RGn. In an embodiment of the disclosure, when the temperature difference between the reference temperature RT and the measurement temperature MST is the first temperature difference DT1 among the temperature differences DT1 to DTm, the gamma correction values GCV11 to GCVn1 respectively corresponding to the reference grayscales RG1 to RGn may have different values from one another. The compensation part CPP may generate the plurality of correction gamma voltages CGV by compensating for the sub-gamma voltages SGV1 to SGVn (See FIG. 7A) corresponding to the reference grayscales RG1 to RGn, respectively. Accordingly, the sub-gamma voltages SGV1 to SGVn are corrected for each gray scale depending on a temperature difference, thereby preventing the quality of the image IM displayed by the display panel DP from being deteriorated by a temperature change.

However, the disclosure is not limited thereto. In an embodiment, the lookup table LUT may store the gamma correction value GCV corresponding to the plurality of temperature differences DT1 to DTm. The reference gamma voltage RGV may be corrected through the single gamma correction value GCV.

The temperature difference calculating part TDC receives the measurement temperature MST from the temperature measuring part TMP. The temperature difference calculating part TDC reads out the reference temperature RT from the second memory MM2. In an embodiment of the disclosure, the reference temperature RT may include sub-reference temperatures SRT1 to SRTn (See FIG. 7B). However, the disclosure is not limited thereto. In an alternative embodiment, for example, the reference temperature RT may be an average value of the sub-reference temperatures SRT1 to SRT1*n*.

The temperature difference calculating part TDC calculates a temperature difference DT between the measurement temperature MST and the reference temperature RT. In an embodiment of the disclosure, when the reference temperature RT includes the sub-reference temperatures SRT1 to SRT1*n*, the temperature difference DT may include a plurality of sub-temperature differences between the sub-reference temperatures SRT1 to SRT1*n* and the measurement temperature MST.

The compensation part CPP receives the temperature difference DT from the temperature difference calculating part TDC. The compensation part CPP reads out the reference gamma voltage RGV from the first memory MM1. The compensation part CPP generates the correction gamma voltage CGV by correcting the reference gamma voltage RGV based on the temperature difference DT. In an embodiment, the compensation part CPP reads out the gamma correction value GCV corresponding to the temperature difference DT from the lookup table LUT. The compensation part CPP may generate the correction gamma voltage CGV by compensating for the reference gamma voltage RGV based on the gamma correction value GCV. In an embodiment of the disclosure, when the temperature difference DT includes sub-temperature differences, the compensation part CPP may read out a plurality of gamma correction values corresponding to the sub-temperature differences from the lookup table LUT. The reference gamma voltage RGV read from the first memory MM1 by the compensation part CPP may include the sub-gamma voltages SGV1 to SGVn. The compensation part CPP may generate the plurality of correction gamma voltages CGV by correcting the sub-gamma voltages SGV1 to SGVn based on a plurality of gamma correction values.

Figure 8:
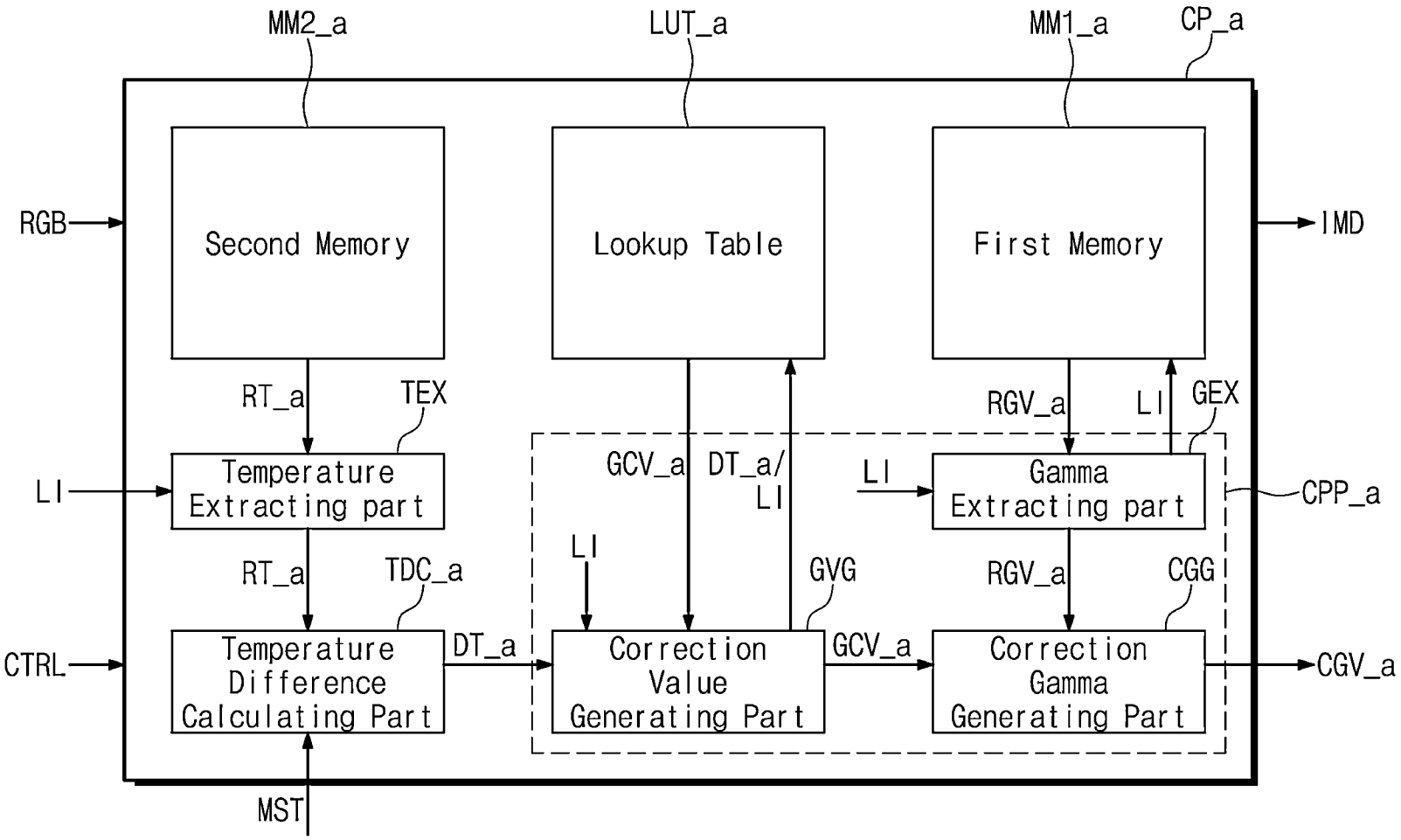
FIG. 8 is a block diagram for describing a structure of a controller, according to an embodiment of the disclosure.
Figure 9A:
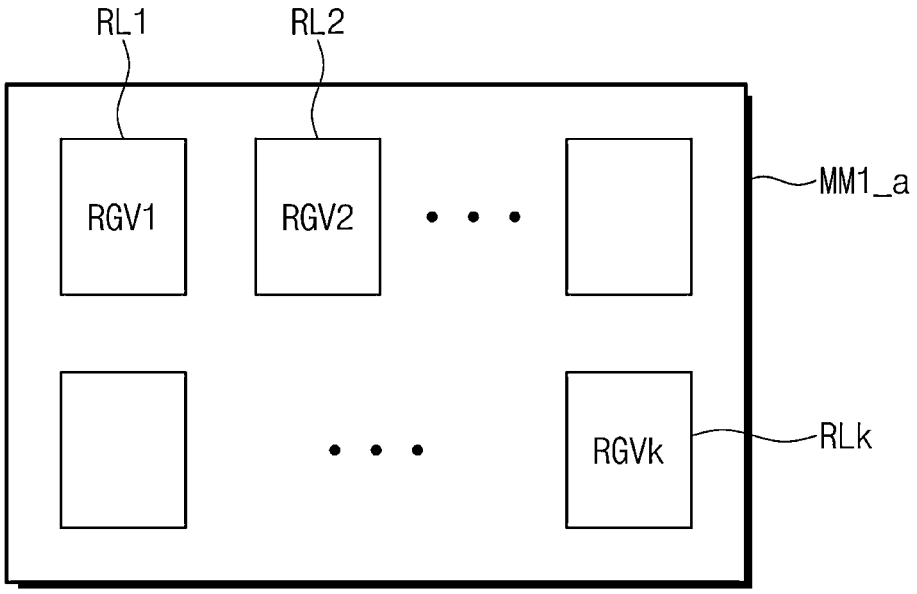
FIG. 9A is a conceptual diagram for describing reference gamma voltages stored in a first memory, according to an embodiment of the disclosure.
Figure 9B:
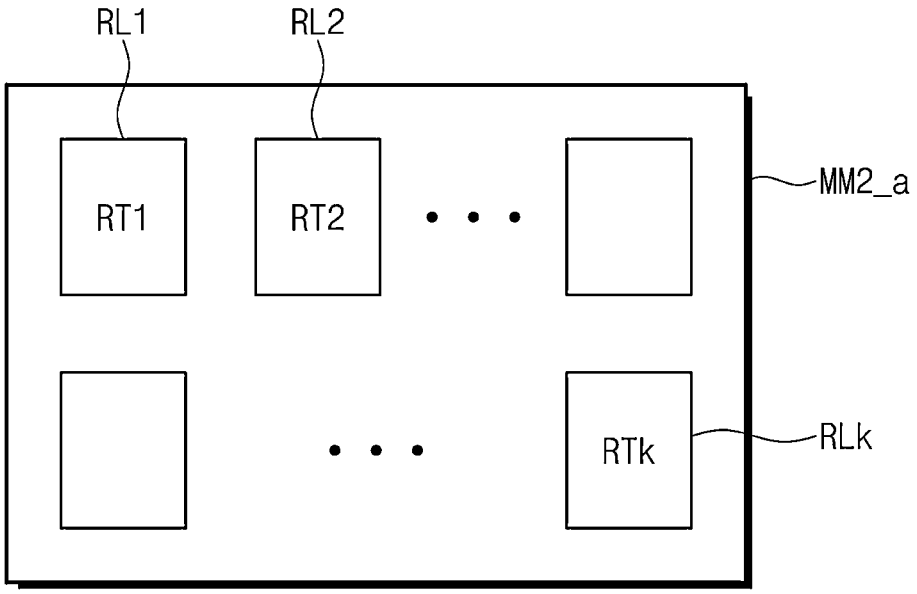
FIG. 9B is a conceptual diagram for describing reference temperatures stored in a second memory, according to an embodiment of the disclosure.
Figure 9C:
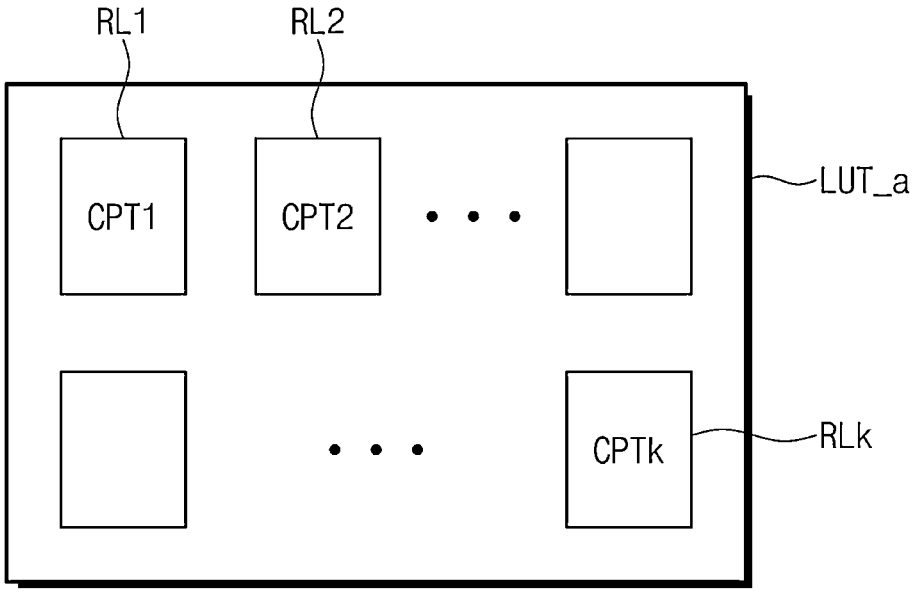
FIG. 9C is a conceptual diagram illustrating correction tables stored in a lookup table, according to an embodiment of the disclosure.

FIG. 8 is a block diagram for describing a structure of a controller, according to an embodiment of the disclosure. FIG. 9A is a conceptual diagram for describing reference gamma voltages stored in a first memory, according to an embodiment of the disclosure. FIG. 9B is a conceptual diagram for describing reference temperatures stored in a second memory, according to an embodiment of the disclosure. FIG. 9C is a conceptual diagram illustrating correction tables stored in a lookup table, according to an embodiment of the disclosure. The same or like elements shown in FIGS. 8 to 9C have been labeled with the same reference characters as used above to describe the embodiments of the controller described above with reference to FIGS. 6 to 7C, and any repetitive detailed description thereof will hereinafter be omitted or simplified.

Referring to FIG. 8, in an embodiment of the disclosure, a controller CP_a includes a temperature extracting part TEX, a temperature difference calculating part TDC_a, a compensation part CPP_a, a first memory MM1_*a*, a second memory MM2_*a*, and a lookup table LUT_a.

Referring to FIGS. 9A and 9B, In an embodiment of the disclosure, the reference gamma voltage RGV may be determined while reference luminances RL1 to RLk of the image IM (see FIG. 1) displayed on the display panel DP (see FIG. 3) are changed. In an embodiment of the disclosure, when the data signal DS (see FIG. 3) having the highest grayscale is applied to the display panel DP, the reference luminances RL1 to RLk may be luminances of the display panel DP. In such an embodiment, even though the display panel DP displays the image IM while the reference luminances RL1 to RLk are changed, the display panel DP may obtain a gamma curve capable of providing a user with optimal display quality.

In an embodiment of the disclosure, the first memory MM1_*a* stores a plurality of reference gamma voltages RGV1 to RGVk respectively corresponding to the plurality of reference luminances RL1 to RLk. In an embodiment, as illustrated in FIG. 7A, each of the reference gamma voltages RGV1 to RGVk may include the plurality of sub-gamma voltages SGV1 to SGVn.

In an embodiment of the disclosure, the second memory MM2_*a* stores a plurality of reference temperatures RT1 to RTk respectively corresponding to the plurality of reference luminances RL1 to RLk. In an embodiment, as illustrated in FIG. 7B, each of the reference temperatures RT1 to RTk may include a plurality of sub-reference temperatures SRT1 to SRTn.

Referring to FIG. 9C, the lookup table LUT may include a plurality of correction tables CPT1 to CPTk, in each of which the gamma correction values GCV (see FIG. 7C)

respectively corresponding to the plurality of reference luminances RL1 to RLk are stored. In an embodiment, the gamma correction value GCV corresponding to the temperature differences DT1 to DTm and the reference grayscales RG1 to RGn (shown in FIG. 7C) may be stored in each of the correction tables CPT1 to CPTk.

Referring to FIGS. 7A to 9C, the display panel DP may display the image IM based on the single reference luminance RL1 of the reference luminances RL1 to RLk. In an embodiment of the disclosure, when the reference luminance RL1 based on the display panel DP is the first reference luminance RL1, luminance information LI may include information indicating that the display panel DP displays the image IM based on the first reference luminance RL1.

The temperature difference calculating part TDC_a receives the measurement temperature MST from the temperature measuring part TMP (see FIG. 3). The measurement temperature MST is the temperature of the display panel DP at a point in time when the display panel DP displays the image IM based on the first reference luminance RL1. The temperature extracting part TEX receives the luminance information LI. The temperature extracting part TEX may read out the reference temperature RT_a, which corresponds to the first reference luminance RL1, from among the reference temperatures RT1 to RTk from the second memory MM2_*a* based on the luminance information LI. The temperature extracting part TEX provides the read reference temperature RT_a to the temperature difference calculating part TDC_a. The temperature difference calculating part TDC_a calculates a temperature difference DT_a based on the measurement temperature MST and the reference temperature RT_a. In an embodiment of the disclosure, where the reference temperature RT_a includes the sub-reference temperatures SRT1 to SRTn, the temperature difference DT_a may include a plurality of sub-temperature differences between the measurement temperature MST and the sub-reference temperatures SRT1 to SRT1*n*.

In an embodiment of the disclosure, the compensation part CPP_a includes a correction value generating part GVG, a gamma extracting part GEX, and a correction gamma generating part CGG. The correction value generating part GVG may receive the luminance information LI. The correction value generating part GVG may read out a gamma correction value GCV_a corresponding to the first reference luminance RL1 and the temperature difference DT_a from the correction tables CPT1 to CPTk based on the luminance information LI and the temperature difference DT_a. In an embodiment of the disclosure, when the temperature difference DT_a includes sub-temperature differences, the gamma correction value GCV_a may include a plurality of gamma correction values corresponding to the temperature differences DT1 to DTm and the reference grayscales RG1 to RGn.

The gamma extracting part GEX may receive the luminance information LI. The gamma extracting part GEX reads out a reference gamma voltage RGV_a, which corresponds to the first reference luminance RL1, from among the reference gamma voltages RGV1 to RGVk from the first memory MM1_*a* based on the luminance information LI. In an embodiment of the disclosure, the reference gamma voltage RGV_a may include the plurality of sub-gamma voltages SGV1 to SGVn.

The correction gamma generating part CGG receives the gamma correction value GCV_a from the correction value generating part GVG, and receives the reference gamma voltage RGV_a from the gamma extracting part GEX. The correction gamma generating part CGG may generate a correction gamma voltage CGV_a by correcting the reference gamma voltage RGV_a based on the gamma correction value GCV_a. The correction gamma generating part CGG may generate the plurality of correction gamma voltages CGV_a by correcting the sub-gamma voltages SGV1 to SGVn based on a plurality of gamma correction values.

Figure 10:
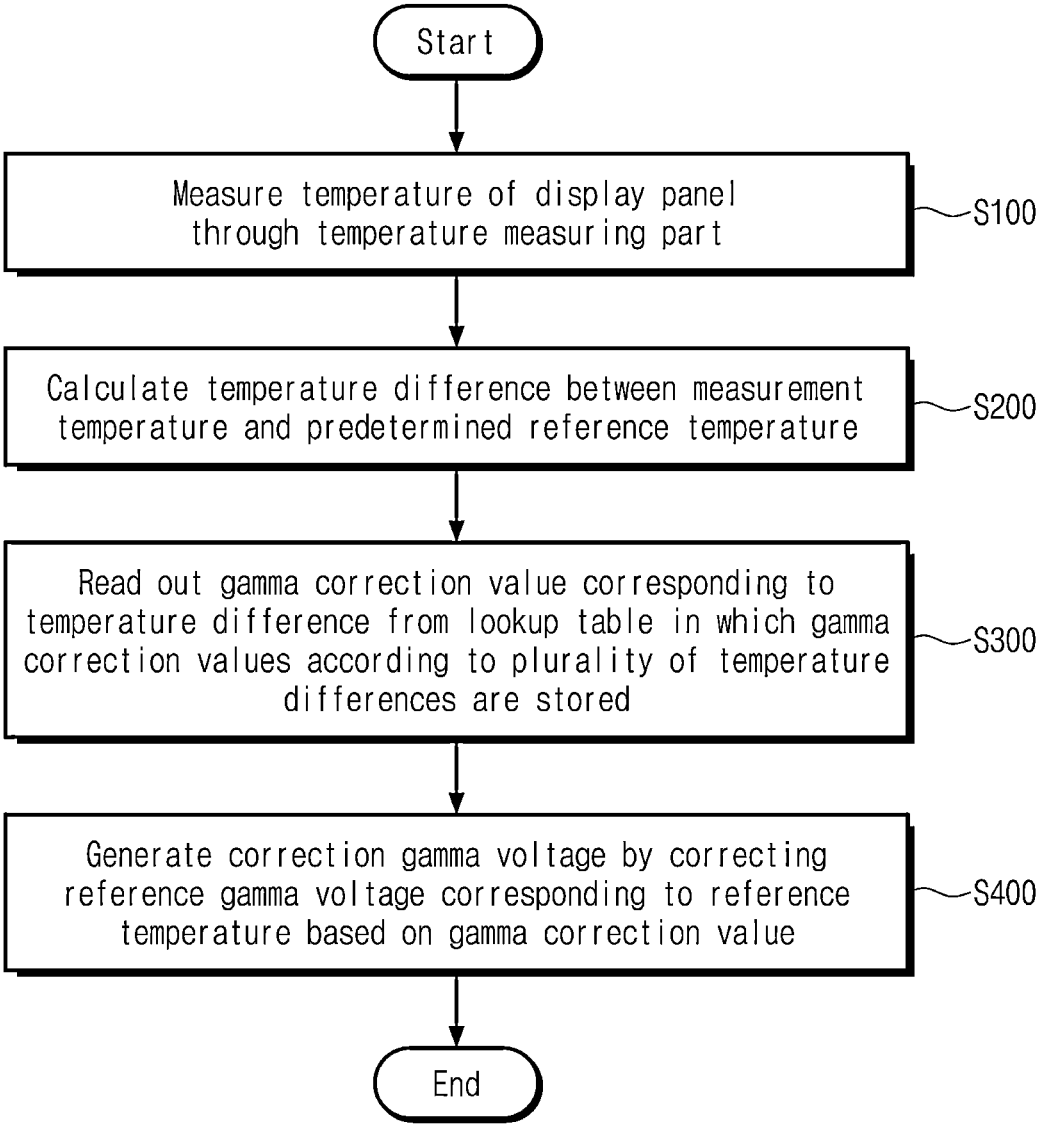
FIGS. 10 and 11 are flowcharts illustrating a method of driving a display device, according to an embodiment of the disclosure.
Figure 11:
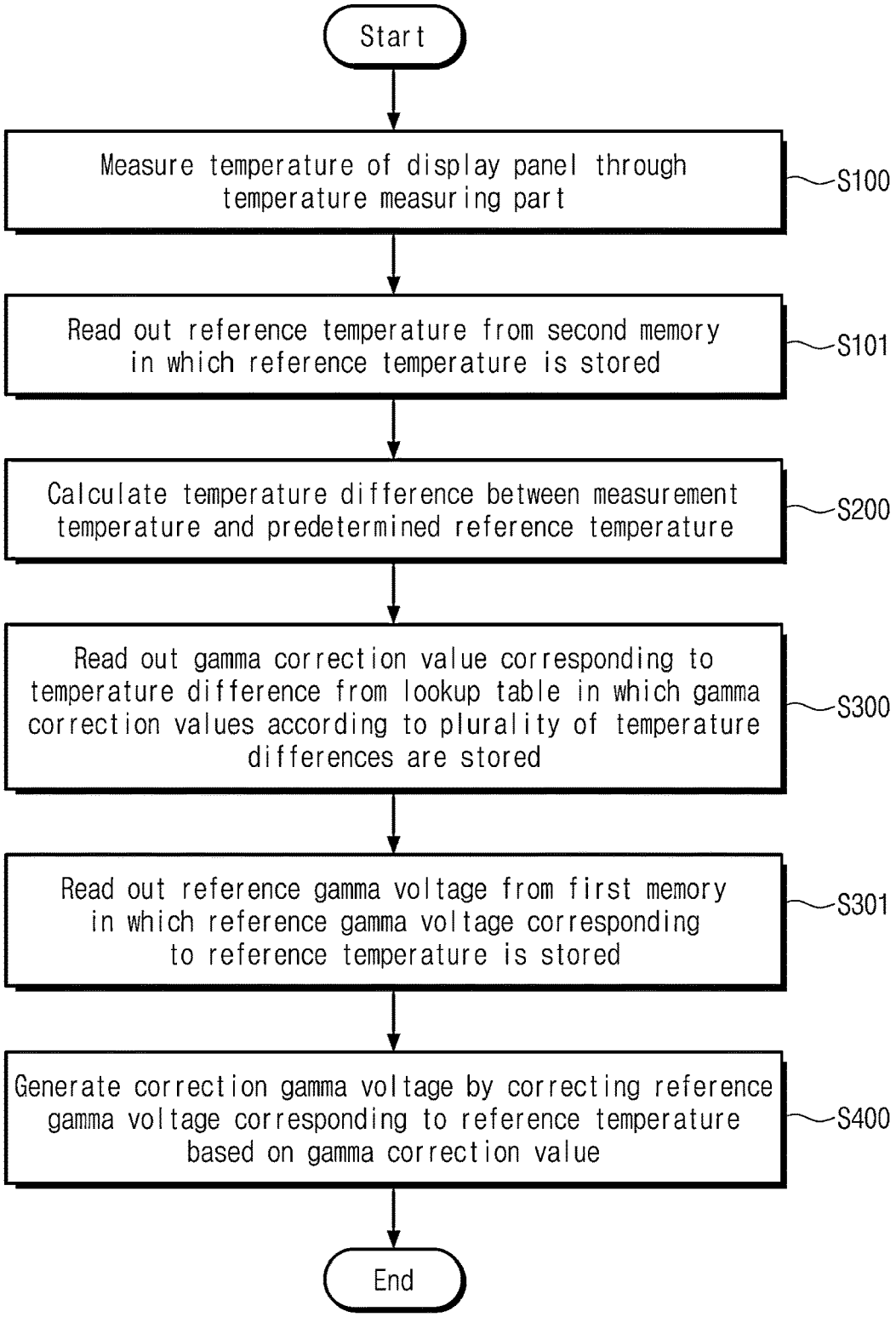

FIGS. 10 and 11 are flowcharts illustrating a method of driving a display device, according to an embodiment of the disclosure.

Referring to FIGS. 3, 6, 7A, 7B, 7C, and 10, in an embodiment, the display device DD (see FIG. 1) of the disclosure may measure the temperature of the display panel DP through the temperature measuring part TMP (S100). The display device DD may calculate the temperature difference DT between the measurement temperature MST measured through the temperature measuring part TMP and the predetermined reference temperature RT (S200). Afterward, the display device DD may read out the gamma correction value GCV corresponding to the temperature difference DT from the lookup table LUT, in which the plurality of gamma correction values GCV11 to GCV1*n* corresponding to the plurality of temperature differences DT1 to DTm are stored (S300), and then may generate the correction gamma voltage CGV by correcting the reference gamma voltage RGV corresponding to the reference temperature RT based on the gamma correction value GCV. In an embodiment of the disclosure, the lookup table LUT may include the gamma correction values GCV11 to GCVnm corresponding to the temperature differences DT1 to DTm and the reference grayscales RG1 to RGn. The display device DD may read out a gamma correction value corresponding to the reference grayscales RG1 to RGn and the temperature difference DT from the lookup table LUT.

The compensation part CPP may generate the correction gamma voltage CGV by correcting the reference gamma voltage RGV corresponding to the reference temperature RT based on the gamma correction value GCV (S400).

Referring to FIGS. 3, 6, 7A, 7B, 7C, and 11, in an embodiment, before calculating the temperature difference DT (S200), the display device DD may read out the reference temperature RT from the second memory MM2 in which the reference temperature RT is stored through the temperature difference calculating part TDC (S101). In such an embodiment, before generating the correction gamma voltage CGV (S400), the display device DD of the disclosure may read out the reference gamma voltage RGV from the first memory MM1 in which the reference gamma voltage RGV corresponding to the reference temperature RT is stored through the compensation part CPP (S301).

According to an embodiment of the disclosure, a temperature difference between predetermined reference temperature and measurement temperature of a display panel is calculated and the display panel is provided with a correction gamma voltage generated by correcting a reference gamma voltage corresponding to the reference temperature based on the corresponding temperature difference. In such an embodiment, even though the reference temperature at a point in time when the reference gamma voltage is set is different from the measurement temperature at a point in time when the display device is used, the quality reliability of an image displayed by the display panel may be maintained.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A display device comprising:

a display panel which displays an image;

a panel driving block which receives an image signal from an outside and provides a data signal to the display panel; and a temperature measuring sensor disposed on or in the display panel, wherein the temperature measuring sensor measures a temperature of the display panel and provides a measurement temperature to the panel driving block, wherein the displays the image based on one reference luminance among a plurality of reference luminances, wherein the one reference luminance is changed from one to another among the reference luminances while the image is displayed, wherein the panel driving block includes:

a controller which generates image data based on the image signal, wherein the controller includes:

a first memory which stores a plurality of reference gamma voltages respectively corresponding to the reference luminances;

a temperature difference calculating part which calculates a temperature difference between a reference temperature and the measurement temperature, wherein the reference temperature is a temperature corresponding to the one reference luminances among a plurality of reference temperatures; and a compensation part which generates a correction gamma voltage by correcting a reference gamma voltage based on the temperature difference between the reference temperature and the measurement temperature, wherein the reference gamma voltage is a voltage corresponding to the one reference luminance among the reference gamma voltages; and a source driver which generates the data signal based on the image data and the correction gamma voltage and provides the data signal to the display panel.

2. The display device of claim 1, wherein the controller further includes:

a lookup table which stores a plurality of gamma correction values corresponding to each of a plurality of temperature differences, wherein the compensation part reads out a gamma correction value, which corresponds to the temperature difference between the reference temperature and the measurement temperature, from among the gamma correction values from the lookup table.

3. The display device of claim 2, wherein the compensation part reads out the reference gamma voltage from the first memory, and generates the correction gamma voltage by correcting the reference gamma voltage based on the gamma correction value.

4. The display device of claim 1, wherein the controller further includes:

a second memory which stores the reference temperature.

5. The display device of claim 4, wherein the temperature difference calculating part reads out the reference temperature from the second memory and receives the measurement temperature from the temperature measuring sensor.

6. The display device of claim 1, wherein each of the reference gamma voltages includes a plurality of sub-gamma voltages respectively corresponding to a plurality of reference grayscales, wherein each of the reference temperature includes a plurality of sub-reference temperatures respectively corresponding to the reference grayscales, and wherein each of the temperature difference includes a plurality of sub-temperature differences which are temperature differences between the measurement temperature and the sub-reference temperatures.

7. The display device of claim 6, wherein the controller further includes:

a lookup table which stores a plurality of gamma correction values corresponding to each of a plurality of temperature differences for each of the reference grayscales, and wherein the compensation part reads out a gamma correction value, which corresponds to the temperature difference between the reference temperature and the measurement temperature, from among the gamma correction values, from the lookup table.

8. The display device of claim 7, wherein the compensation part reads out the reference gamma voltage from the first memory and generates the correction gamma voltage by correcting the reference gamma voltage based on the gamma correction value.

9. The display device of claim 1, wherein the controller further includes:

a second memory which stores the reference temperatures respectively corresponding to the reference luminances.

10. The display device of claim 9, wherein the controller further includes:

a temperature extracting part which reads out the reference temperature from the second memory, and wherein the temperature extracting part provides the reference temperature to the compensation part.

11. The display device of claim 9, wherein the controller further includes:

a lookup table including a plurality of correction tables, each of which stores a plurality of gamma correction values corresponding to each of a plurality of temperature differences for each of the reference luminances, and wherein the compensation part reads out a gamma correction value, which corresponds to the reference luminance and the temperature difference between the reference temperature and the measurement temperature, from among the gamma correction values, from the lookup table.

12. The display device of claim 11, wherein the compensation part includes:

a gamma extracting part which reads out the reference gamma voltage from the first memory;

a correction value generating part which reads out the gamma correction value from the lookup table; and a correction gamma generating part which receives the reference gamma voltage from the gamma extracting part, receives the gamma correction value from the correction value generating part, and generates the correction gamma voltage by correcting the reference gamma voltage based on the gamma correction value.

13. A driving method of a display device, the method comprising:

displaying an image on a display panel of the display device based on one reference luminance among a plurality of reference luminances where the one reference luminance is changed from one to another among the reference luminances while the image s displayed;

measuring a temperature of the display panel through a temperature measuring sensor disposed on or in the display panel of the display device;

calculating a temperature difference between the measured temperature and a reference temperature, wherein the reference temperature is a temperature corresponding to the one reference luminances among a plurality of reference temperature;

reading out a gamma correction value corresponding to the temperature difference between the reference temperature and the measurement temperature from a lookup table, in which a plurality of gamma correction values corresponding to each of a plurality of temperature differences, are stored; and generating a correction gamma voltage by correcting a reference gamma voltage based on the gamma correction value, wherein the reference gamma voltage is a voltage corresponding to the one reference luminance among a plurality of reference gamma voltage respectively corresponding to the reference luminances.

14. The method of claim 13, further comprising:

reading out the reference temperature from a second memory in which the reference temperatures are stored.

15. The method of claim 14, wherein the first memory stores the reference gamma voltages respectively corresponding to the reference luminances.

16. The method of claim 15, wherein the second memory stores the reference temperatures respectively corresponding to the reference luminances.

17. The method of claim 16, wherein the lookup table stores a plurality of gamma correction values corresponding to each of the temperature differences for each of the reference luminances, and wherein the gamma correction value is a correction value, which corresponds to the one reference luminance and the reference temperature, from among the gamma correction values.

* * * * *